US005398855A

United States Patent [19]

Schaiewitz

[11] Patent Number: 5,398,855

[45] Date of Patent: Mar. 21, 1995

[54] PAGER CARRYING DEVICE

[76] Inventor: Daniel Schaiewitz, P.O. Box 312, Yonkers, N.Y. 10710

[21] Appl. No.: 223,232

[22] Filed: Apr. 5, 1994

[51] Int. Cl.[6] ..... A45F 3/14

[52] U.S. Cl. ..... 224/257; 224/202; 224/250; 24/3 B

[58] Field of Search ..... 224/202, 257, 258, 250, 224/220, 267, 249, 251; 24/3 B, 3 M, 3 A, 370, 371; 294/148, 166

[56] References Cited

U.S. PATENT DOCUMENTS

| | | | |
|---|---|---|---|
| 2,911,694 | 11/1959 | Seron | 24/3371 |
| 3,797,075 | 3/1974 | Seron | 224/202 |
| 4,674,298 | 6/1987 | Wimmershoff-Caplan | 224/202 |

*Primary Examiner*—Linda J. Sholl
*Attorney, Agent, or Firm*—Martin J. Spellman, Jr.

[57] ABSTRACT

A pager carrying device including a fabric woven cord having the ends crimped together at one end of a metallic crimp. The other end of the metallic crimp secures the ends of an elastic looped material. The latter being designed so that it may be expanded to readily fit over the spring biased securing clip on the rear wall of conventional beepers. In its unexpanded condition, it serves to securely hold the loop around the pivot end of the beeper retainer clip on the rear side of the beeper case. The device is worn around the user's neck with the beeper suspended at mid chest position of the user making it easy to read and operate the beeper.

1 Claim, 1 Drawing Sheet

PAGER CARRYING DEVICE

BACKGROUND OF THE INVENTION

The present invention relates to devices for securely and conveniently carrying and using telephone pagers or beepers. Most personal beepers today are carried on the user's belt and held there by a spring biased clip. This makes the pager awkward and inconvenient to access for use.

Other methods include linked jewelry type of safety chains clipped to a bar presently on most beepers on a first and clipped at a remote second end to a user's belt, belt loop or the like. Such chains are bulky and generally gaudy.

SUMMARY OF THE INVENTION

In accordance with the present invention, there is provided a greatly improved pager beeper carrier for securely retaining pager beepers on the user's person in a manner so that the beeper is conveniently accessible for use. The device is inexpensive, provides a secure means of holding the beeper on the user and makes the beeper much easier to use.

The majority of beeper/pagers currently in use have a spring biased belt clip mounted on the rear surface of the pager case.

Utilization of the chains mentioned above requires an excess length of chain in order that the beeper be accessible for the person using it to view the number of other messages and to operate the controls of the beeper. In addition, if the user drops the pager from his hand, it tends to jerk abruptly on the chain possibly snapping the chain links or ripping a belt loop or other portion of apparel to which the chain is attached.

With the present invention, there is provided a beeper carrier device comprising a knitted cord having the ends crimped together at one end of a metallic crimp. The other end of the metallic crimp secures the ends of an elastic looped material. The latter is designed so that it may be expanded to readily fit over the spring biased securing clip on the rear wall of conventional beepers. In its unexpanded condition, it serves to securely hold the loop around the pivot end of the beeper retainer clip on the rear side of the beeper case. The device is worn around the user's neck with the beeper suspended at mid chest position of the user making it easy to read and operate the beeper.

BRIEF DESCRIPTION OF THE DRAWING

In the accompanying drawing which forms a part of this specification.

ILLUSTRATIVE SPECIFIC EMBODIMENT

In the accompanying drawing, the pager carrying device 2 of the present invention for a beeper 4 is shown worn around a user's 6 neck.

The beeper case includes switch 10 and display window 8.

Figure 1:
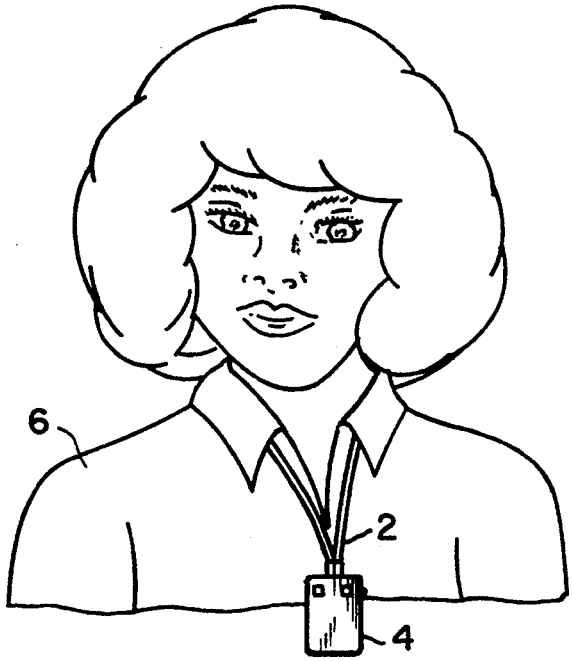
FIG. 1 is a plan view showing a beeper secured around a user's neck with the device of the present invention.
Figure 2:
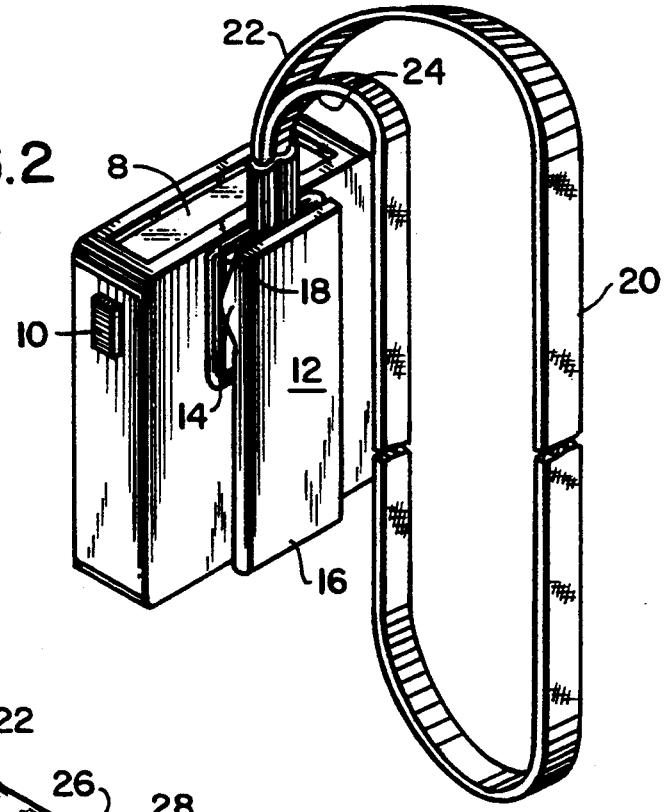
FIG. 2 is a perspective view of the device of the present invention and its mounting on a standard beeper case.
Figure 3:
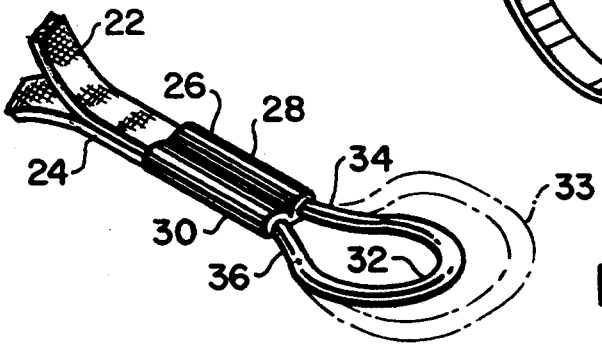
FIG. 3 is a perspective view of the crimped end of the neck cord and elastic loop.

The device 2 comprises a strand 20 of flat knitted or woven material such as cotton or nylon such as used in laces for athletic shoes. The Strand has a first end section 22 and second end section 24. The length of the strand 20 is generally between 2 feet and 3 feet in length. The ends 22 and 24 are crimped together by ferrule 26 having ridges 28 and 30 together on top of each other as shown in FIG. 3. Opposed to the strand 24 and 26 in the crimp 26 is a loop 32 of elastic cord having the ends 34 and 36 thereof as retained in the crimp 26 as shown. The length of the loop 32 in the unstretched state as shown in solid lines in FIG. 3 is about 2 to 3 inches. It is stretchable to the position 33 as shown by the dotted lines in order to fit over the end 16 of the spring biased hinge 14 of the retainer clip 12 on the rear wall 18 of the beeper case.

The device of this invention eliminates the awkward chains commonly used. The beeper can thus be carried and used conveniently and safely.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A pager carrying device for carrying a pager comprising a flat fabric woven cord having a first end and a second end, said cord being from 2 to 3 feet in length, said first and said second ends being crimped together at one end of a metallic crimp, and an elastic cord from 2 to 3 inches in length having a first end and a second end being crimped together at the opposed end of said crimp securing the ends of said cord.

* * * * *